US007140297B2

(12) United States Patent
Kawamura

(10) Patent No.: US 7,140,297 B2
(45) Date of Patent: Nov. 28, 2006

(54) PRINTING PROCESS AND MANUFACTURING PROCESS OF PRINTING PLATE MATERIAL

(75) Inventor: Tomonori Kawamura, Hachioji (JP)

(73) Assignee: Konica Minolta Medical & Graphic, Inc., Tokyo (JP)

( * ) Notice: Subject to any disclaimer, the term of this patent is extended or adjusted under 35 U.S.C. 154(b) by 0 days.

(21) Appl. No.: 11/011,003

(22) Filed: Dec. 13, 2004

(65) Prior Publication Data

US 2005/0132915 A1 Jun. 23, 2005

(30) Foreign Application Priority Data

Dec. 22, 2003 (JP) ..... 2003-424392

(51) Int. Cl.

| | |
|---|---|
| ***B41M 1/06*** | (2006.01) |
| ***B41M 5/26*** | (2006.01) |
| ***B41N 1/00*** | (2006.01) |
| ***B41N 3/08*** | (2006.01) |

(52) U.S. Cl. ..... 101/451; 101/467; 101/463.1; 101/450.1; 430/302

(58) Field of Classification Search ..... None
See application file for complete search history.

(56) References Cited

U.S. PATENT DOCUMENTS

| | | | | |
|---|---|---|---|---|
| 4,970,138 | A | 11/1990 | Lauke et al. | |
| 5,665,522 | A * | 9/1997 | Vogel et al. | 430/278.1 |
| 6,110,640 | A * | 8/2000 | Kawamura et al. | 430/270.1 |
| 2003/0180658 | A1 | 9/2003 | Goodin et al. | |
| 2004/0048191 | A1* | 3/2004 | Inno | 430/270.1 |
| 2004/0134365 | A1* | 7/2004 | Mori | 101/459 |
| 2004/0211331 | A1* | 10/2004 | Mori | 101/483 |
| 2005/0056179 | A1* | 3/2005 | Mori | 101/457 |
| 2005/0170282 | A1* | 8/2005 | Inno et al. | 430/270.1 |

FOREIGN PATENT DOCUMENTS

| | | | |
|---|---|---|---|
| EP | 0770495 | A | 5/1997 |
| EP | 1052113 | A | 11/2000 |
| EP | 1279520 | A | 1/2003 |
| EP | 0911153 | A | 4/2003 |

* cited by examiner

*Primary Examiner*—Andrew H. Hirshfeld
*Assistant Examiner*—Joshua Zimmerman
(74) *Attorney, Agent, or Firm*—Lucas & Mercanti, LLP

(57) ABSTRACT

Disclosed is a printing process employing a printing plate material obtained by providing, on a support, a coating solution for an image formation layer capable of forming an image by heating, the process comprising the steps of imagewise heating the printing plate material, and then carrying out printing supplying printing ink and a dampening solution to the heated printing plate material, wherein the acid base property of the coating solution is the reverse of that of the dampening solution.

12 Claims, No Drawings

PRINTING PROCESS AND MANUFACTURING PROCESS OF PRINTING PLATE MATERIAL

FIELD OF THE INVENTION

The present invention relates to a printing plate material, and particularly to a printing plate material capable of forming an image by a computer to plate (CTP) system and a printing process employing the same.

BACKGROUND OF THE INVENTION

The planographic printing plate material for CTP, which is inexpensive, can be easily handled, and has a printing ability comparable with that of a PS plate, is required accompanied with the digitization of printing data. Recently, a versatile thermal processless printing plate material, which can be applied to a printing press employing a direct imaging (DI) process without development by a special developing agent and which can be treated in the same manner as in PS plates, has been required.

As a thermal processless printing plate material, there is Thermo-Lite produced by Agfa Co., Ltd.

In a thermal processless printing plate material, an image is formed according to a recording method employing a thermal laser emitting light with infrared to near infrared wavelengths. The thermal processless type printing plate material employing this recording method is divided into two, an ablation type printing plate material, and a phase change type printing plate material.

Examples of the ablation type printing plate material include those disclosed in for example, Japanese Patent O.P.I. Publication Nos. 8-507727, 6-186750, 6-199064, 7-314934, 10-58636 and 10-244773. Examples of the phase change type printing plate material include those disclosed in for example, Japanese Patent O.P.I. Publication No. 11-240270. In the phase change type printing plate material, the hydrophilic layer contains hydrophobe precursor particles, which are not removed during printing, and the hydrophilic layer at exposed portions changes to be hydrophobic.

When an on-press development type planographic printing plate material as described above is used which does not require any special development before mounting on a printing press, an image formation layer at non-image portions of the printing plate material is transferred to printing paper sheets or to a dampening solution, whereby a printing plate is obtained. However, this process has mainly two problems to be solved.

One is that it is difficult to prevent lowering of durability of an image formation layer at image portions and lowering of printing durability, since it is necessary that the image formation layer have some degree of water affinity in order to remove rapidly an image formation layer at non-image portions from the printing plate.

A planographic printing plate material is required to have a plate inspection property for checking before printing whether or not a correct visible image is formed on a planographic printing plate material after imagewise exposure. A planographic printing plate material having such a plate inspection property comprises a colorant, and the colorant is released in a printing press during printing, resulting in contamination of the printing press. That is, the other problem is that a colorant or a color producing agent contained in a planographic printing plate material contaminates prints or a dampening solution.

As planographic printing plate materials requiring no development, there are ones disclosed in Japanese Patent O.P.I. Publication Nos. 2003-25750, 2003-39840 and 2003-246155, in which the image formation layer contains a specific heat fusible polymer, whereby developability and printing durability are improved, and printing press contamination is minimized. However, there is neither disclosure nor suggestion in these documents of a visible image formation that employing a colorant, a visible image is formed after imagewise exposure.

A positive working planographic printing plate material comprising a layer to be rendered hydrophilic by heat and a method of preventing stain occurrence at non-image portions are disclosed in Japanese Patent O.P.I. Publication No. 11-174685. However, there is no disclosure in this document of improvement in printing durability and visible image formation after exposure.

As a conventional technique for forming a visible image without contamination of a printing press and printed matter, there is a technique in which a colorless leuco dye is reacted with a developing agent to form a dye image. In order to secure a practically acceptable visible image, a large amount of the leuco dye is incorporated into an image formation layer, resulting in problem of lowering developability on a printing press. Further, the technique has a problem in that the leuco dye and developing agent in the image formation layer were incorporated into a dampening solution and reacted with each other therein, resulting in contamination of a printing press or printed matter.

SUMMARY OF THE INVENTION

An object of the invention is to provide a printing process comprising imagewise exposing a printing plate material comprising a support and provided thereon, an image formation layer containing a component with some affinity to water, wherein after exposure a visible image is formed on the printing plate material, and to provide a printing plate material used in the printing process providing high printing durability.

DETAILED DESCRIPTION OF THE INVENTION

As a conventional dampening solution, an acidic or basic dampening solution is used according to properties of printing paper or printing ink used. The present inventors have made an extensive study, and found that durability of image portions of a printing plate is enhanced when the acid/basic property of the dampening solution is the reverse of that of the image formation layer coating solution in a planographic printing plate material requiring no special development.

Further, they have found that an image formation layer can form a visible image on imagewise exposure without contaminating a printing press or printed matter by incorporating, into the image formation layer coating solution, a compound which is preferably colored in the coating solution but changes in color in a dampening solution during printing to be substantially colorless.

The object of the invention can be attained by any one of the following constitutions.

1. A printing process employing a printing plate material obtained by providing, on a support, a coating solution for an image formation layer capable of forming an image by heating, the process comprising the steps of:

imagewise heating the printing plate material; and then carrying out printing supplying printing ink and a dampening solution to the heated printing plate material, wherein the acid base property of the coating solution is the reverse of that of the dampening solution.

2. The printing process of item 1 above, wherein the coating solution contains a visualizing material to change in color due to variation of pH of the coating solution.

3. The printing process of item 2 above, wherein the visualizing material is colored at the pH of the coating solution.

4. The printing process of item 2 above, wherein the visualizing material has a melting or decomposition point of not more than 250° C.

5. The printing process of item 3 above, wherein the visualizing material has a melting or decomposition point of not more than 250° C.

6. A manufacturing process of a printing plate material comprising a support and provided thereon, an image formation layer capable of forming an image by heat, the printing plate material being imagewise heated, and then printing being carried out supplying printing ink and a dampening solution to the heated printing plate material, the process comprising the steps of:

providing a coating solution for the image formation layer on a support, wherein an acid base property of the coating solution is the reverse of that of the dampening solution.

7. The manufacturing process of item 6 above, wherein the coating solution contains a visualizing material to change in color due to variation of pH of the coating solution.

8. The manufacturing process of item 7 above, wherein the visualizing material is colored at the pH of the coating solution.

9. The manufacturing process of item 7 above, wherein the visualizing material has a melting or decomposition point of not more than 250° C.

10. The manufacturing process of item 8 above, wherein the visualizing material has a melting or decomposition point of not more than 250° C.

1-1. A printing process comprising the steps of imagewise heating a printing plate material comprising a support and provided thereon, an image formation layer capable of forming an image by heat, mounting the heated printing plate material on a plate cylinder of a printing press without processing it with a processing agent, and then carrying out printing employing the mounted printing plate material, wherein an acid base property of a coating solution for the image formation layer is different from that of a dampening solution used during printing.

1-2. The printing process of item 1-1 above, wherein the coating solution for the image formation layer contains a visualizing material which is colored, changed in color, faded or decolored due to variation of the pH.

1-3. The printing process of item 1-2 above, wherein the visualizing material is colored at the pH of the coating solution.

1-4. The printing process of item 1-2 or 1-3 above, wherein the visualizing material has a melting or decomposition point of not more than 250° C.

1-5. A printing plate material comprising a support and provided thereon, an image formation layer capable of forming an image by heat, an acid base property of a coating solution for the image formation layer being the reverse of that of a dampening solution used during printing, wherein the printing plate material is imagewise heated, mounted on a plate cylinder of a printing press without being processed it with a processing agent, and then printing is carried out employing the mounted printing plate material.

1-6. The printing plate material of item 1-5 above, wherein the coating solution for the image formation layer contains a visualizing material which is colored, changed in color, faded or decolored due to variation of the pH.

1-7. The printing plate material of item 1-6 above, wherein the visualizing material is colored at the pH of the coating solution.

1-8. The printing plate material of item 1-6 or 1-7 above, wherein the visualizing material has a melting or decomposition point of not more than 250° C.

As one embodiment of the printing plate material of the invention, there is a printing plate material comprising a substrate having a hydrophilic surface (support) and provided thereon, an image formation layer capable of being developed on a press (on-press developed).

Typically, there is a printing plate material comprising a substrate having a hydrophilic surface (for example, a grained aluminum plate or a resin or metal substrate on the surface of which a hydrophilic layer is provided), and provided thereon, an image formation layer capable of being an on-press developed containing hydrophobe precursor particles described later.

In this embodiment, a light-to-heat conversion material can be contained in the image formation layer or in the support surface (hydrophilic layer).

When this printing plate material is exposed to infrared laser, a layer at exposed portions colors, and is made hydrophobic by the hydrophobe precursor to form image portions which are not removed on a press. An image formation layer at unexposed portions is removed by a dampening roller supplying a dampening solution or an inking roller supplying a printing ink, or may be finally transferred onto a printing paper sheet during printing.

<Image Formation Layer Formation Method>

The image formation layer in the invention can be formed coating, on a support, a coating solution for an image formation layer in which materials described above are dispersed or dissolved in a solvent containing water. In the invention, the acid base property of the coating solution for the image formation layer is the reverse of that of a dampening solution used in printing. This means that when the coating solution is acidic, the dampening solution is basic or when the coating solution is basic, the dampening solution is acidic. For example, when a dampening solution used in printing is acidic, it is important to render the image formation layer coating solution basic.

In the invention, "acidic" means that the pH of a solution is not more than 6.0 at 25° C, while "basic" means that the pH of a solution is not less than 8.0 at 25° C.

<Visualizing Material>

In the invention, it is preferred that the image formation layer coating solution contains a compound (hereinafter also referred to as visualizing material) which provides a visible image on an image formation layer after imagewise exposure and is subject to change in color due to variation of the pH of the coating solution. In the invention, "change in color" means coloration, reduction of color density or decoloration (bleaching).

The visualizing material is preferably a compound, which is colored at the pH of the image formation layer coating solution but changes in color at the pH of a dampening solution, and more preferably the compound further having a melting or decomposition point of not more than 250° C.

Incorporation of such a compound in the image formation layer provides a colored image formation layer. After the colored image formation layer is imagewise heated, the compound at heated portions is melted or decomposed, resulting in color differences between the image portions and non-image portions, whereby a visible image is formed.

Further, when the heated printing plate material being mounted on a printing press, printing is carried out, the compound at the non-image portions is transferred to printed matter or a dampening solution through a blanket, inking roller or dampening roller of the printing press. After that transfer, the compound changes in color in the dampening solution whose acid base property is the reverse of the image formation layer, without lowering quality of the solution.

Examples of the visualizing material used in the invention include compounds as shown below. These exhibit a different color density or a different color tone due to different pH values of the dampening solution. Therefore, those satisfying the scope as claimed are selected from the listed compounds.

In the invention, the visualizing material, which is colored at the pH of an image formation layer coating solution and changes in color at the pH of a dampening solution, can be used without special limitations, as long as the image formation layer coating solution is observed to be colored. It is important that although during printing, a part of the visualizing material is transferred to printing paper sheets and remains on prints, color difference between non-image portions of the prints and the printing paper sheets is not visually observed, and contamination of printing ink or a dampening solution due to incorporation of the visualizing material is also not visually observed.

Examples of the visualizing material are as: Methyl Violet, Thymol Blue, Methyl Yellow, Bromophenol Blue, Methyl Orange, Methyl Red, Bromothymol Blue (BTB), Phenol Red, Phenolphthalein, Thymolphthalein, and Alizarin Yellow R.

Among these materials are preferably those having a melting or decomposition point of not more than 250° C. This is because when the image formation layer is imagewise heated, heated portions change to a state different from unheated portions corresponding to non-image portions to form a clear visible image. A visualizing material having a melting or decomposition point of not more than 250° C. can provide a visible image even if exposure energy is insufficient. Further, such a material is melted or decomposed on heating to promote plasticization of the image formation layer, which can reduce the exposure energy necessary to form an image. A visualizing material, which provides a higher color density at the pH of the image formation layer coating solution, is preferred, while a visualizing material, which provides a lower color density at the pH of the dampening solution, is also preferred.

The visualizing material has a melting or decomposition point of preferably not less than 50° C.

A visualizing material has solubility in water or alcohol of preferably not less than 0.1 g/liter. Further, a visualizing material having high fastness to visible light is preferred.

For example, when the pH of a dampening solution used for printing is acidic (not more than 6), 0.1 to 1.0 g/liter of Bromothymol Blue (melting point accompanying decomposition: 200–202° C.) is added to an image formation layer coating solution having a pH of not less than 8.0, and preferably not less than 9.0. When a printing plate material manufactured by coating the resulting image formation layer coating solution on a support is imagewise exposed to infrared laser, the exposed portions are instantly heated to more than the melting point of the Bromothymol Blue, and the compound in the exposed portions is decomposed, resulting in color difference between image portions and non-image portions, whereby a visible image is formed.

When this exposed printing plate material being mounted on a printing press and developed on the press, printing is carried out, the visualizing material, Bromothymol Blue in non-image portions changes its color from blue-green to yellow or colorless due to the pH of the acidic dampening solution, resulting in no undesired (colored) stains on the prints or the printing press.

Detailed embodiment will be explained later employing examples.

<Light-To-Heat Conversion Material>

The preferred embodiment of the printing plate material of the invention comprises at least one layer containing a light-to-heat conversion material. An image can be formed on a printing plate material comprising no light-to-heat conversion material employing a known thermal head, however, incorporation of the light-to-heat conversion material in a printing plate material makes it possible to form an image employing an infrared laser.

As the light-to-heat conversion materials, there are the following materials: organic compounds such as infrared absorbing dyes, for example, a cyanine dye, a chloconium dye, a polymethine dye, an azulenium dye, a squalenum dye, a thiopyrylium dye, a naphthoquinone dye, and an anthraquinone dye; an organometallic complex such as a phthalocyanine compound, a naphthalocyanine compound, an azo compound, a thioamide compound, a dithiol compound or an indoaniline compound; and pigments such as carbon, graphite, metals, and metal oxides.

As the carbon, furnace black or acetylene black is preferred. The graininess (d50) thereof is preferably not more than 100 nm, and more preferably not more than 50 nm. The particle diameter of the graphite is preferably not more than 0.5 μm, more preferably not more than 100 nm, and still more preferably not more than 50 nm.

As image formation methods preferably used in the invention, there are various image formation methods employing an infrared laser such as one employing ablation due to infrared laser, and one (on-press development, phase change) employing heat-melt or heat-fusion due to infrared laser.

As a preferred printing plate material, there is a printing plate material of on-press development type having a support and provided thereon, a hydrophilic layer and an image formation layer containing a hydrophobe precursor particles in that order, each layer being described later, and an image is formed on the printing plate material employing heat-melt or heat-fusion due to infrared laser.

Planographic printing employs a property that water and oil repel each other. In the planographic printing, when a dampening solution and printing ink are supplied to a printing plate, the dampening solution is accepted on hydrophilic non-image portions of the printing plate, and the printing ink is selectively received on oleophilic image portions of the printing plate, and transferred to a printing paper sheet through a rubber called blanket. Herein, the dampening solution prevents printing ink from adhering to the non-image portions.

A dampener is required to supply a dampening solution to the non-image portions to form a uniform dampening solution film with a minimum thickness thereon. As the type of the dampening solution supply, there are a molleton roller supply type, a brush roller supply type, a spray supply type, and a continuous supply type.

In the molleton roller supply type, a form dampening roller covered with cloth and a dampening solution transfer roller are impregnated with a dampening solution, and the dampening solution is transported to a printing plate through reciprocal motion of the dampening solution transfer roller.

In the continuous type, a dampening solution film formed on the surface of hydrophilic metal rollers and rubber rollers to be connected is continuously supplied to a printing plate surface. Unlike the molleton roller supply type, the rollers of the continuous type are connected in series from the dampening solution fountain to a printing plate surface and the supply amount of the dampening solution is adjusted by the rotational speed of a water fountain roller.

A dampening solution is ordinarily prepared by diluting an etching solution described later with water or isopropyl alcohol (IPA).

An etching solution for the molleton roller supply method, a typical etching solution is generally an acidic solution (with a pH of 3 to 6). The etching solution contains a water-soluble resin, an inorganic salt, an inorganic acid, an organic acid and a surfactant. Gum arabic, CMC (carboxymethylcellulose), or dextrin derivatives are used as the water-soluble resin, which contribute to protection or hydrophilization of non-image portions of a printing plate. Phosphates or nitrates are used as the inorganic salt, and carboxylic acids such as citric acid and tartaric acid as the organic acids. These are used for adjusting pH of the dampening solution or for rendering the non-image portions of a printing plate more hydrophilic. As the surfactant, nonionic surfactant or an anionic surfactant is used. The surfactant lowers a surface tension and increases wettability at non-image portions of a printing plate.

Herein, the etching solution can be a dampening solution to be supplied to a printing plate, but generally means a chemical to be added to a dampening solution. Incorporation of the etching solution to a dampening solution can greatly improve printing performance of a printing plate.

A function required for the etching solution is to enhance hydrophilicity or water retention property at non-image portions of a printing plate. Regarding hydrophilicity, a main function of a dampening solution is to repel printing ink at non-image portions, wherein it is necessary to reduce a surface tension of the dampening solution so that the dampening solution penetrates into fine configurations of non-image portions with no ink of a printing plate. Thus, the surface tension reduction can fill the fine pores with the dampening solution. Thus, the surface tension reduction makes it easy for the dampening solution to permeate into the fine surface configurations.

Regarding the water retention property, a dampening solution is required to remain at non-image portions for a certain period, since when the dampening solution at the non-image portions is evaporated before printing ink is supplied to the printing plate, the printing ink is adhered to the non-image portions, resulting in stain occurrence.

The etching solution may be required to have another additional function; one adjusting temperature of printing ink or the printing plate surface, one setting printing ink, or one reducing a supply amount of the dampening solution.

An etching solution for a continuous dampening solution supply system is one adding a function of IPA to an etching solution for a molleton roller dampening solution supply system. As a surface tension reducing agent, water miscible alcohols, glycols, or glycol ethers are used, which do not belong to organic solvents of the second kind defined in the "Organic Solvent Regulation". In order to further enhance a surface tension reduction capability, specific surfactants (for example, nonionic surfactants such as an ethylene oxide or propylene oxide adduct of glycols or glycol ethers) are also used. As a viscosity increasing agent, resins which are soluble in both water and an organic solvent are preferably used, instead of gum arabic or CMC conventionally used, each being sparingly soluble in the organic solvent as described above. Examples of the resins include methylcellulose, hydroxyethylcellulose, polyacrylamide or its copolymer, polyvinylpyrrolidone or its copolymer, and vinyl methyl ether-maleic anhydride copolymer.

The inorganic or organic salts used for hydrophilization of non-image portions of a printing plate or pH adjustment are the same as those ordinarily used. This type of the etching solution usually contains an antiseptic agent as an alternative of IPA having bactericidal action.

A basic etching solution (with a pH of 8 to 12) is mainly used in a rotary press for newspaper. The etching solution contains as a main component a mixture of sodium phosphate, sodium silicate and sodium carbonate component, and further contains a surfactant, glycols, and polymer resins. In this etching solution, detergency of metals, which the alkali agents have, contributes to hydrophilization at non-image portions of a printing plate.

A dampening solution is ordinarily adjusted to either an acidic side or a basic side in order to maintain its pH stability. It is because when a dampening solution is neutral, the pH is likely to vary by components incorporated in the dampening solution from a printing plate, a printing paper, and printing ink used, resulting in lowering of printing quality.

<Support (Substrate)>

As the support in the invention, a metal plate or a plastic film sheet well known as the support for printing plates can be used. The thickness of the support is not specifically limited as long as a printing plate having the support can be mounted on a printing press, and is preferably from 50 to 500 μm in easily handling.

Examples of the metal plate include iron, stainless steel, and aluminum. Aluminum is especially preferable in its gravity and stiffness. Aluminum is ordinarily used after degreased with an alkali, an acid or a solvent to remove oil on the surface, which has been used when rolled and wound around a spool. The degreasing is carried out preferably employing an aqueous alkali solution. In order to increase adhesion between the support and a coating layer, it is preferred that the surface of the support is subjected to adhesion increasing treatment or is coated with a subbing layer.

For example, the support is immersed in a solution containing silicate or a coupling agent such as a silane coupling agent, or the support is coated with the solution and then sufficiently dried. Anodization treatment is considered to be one kind of adhesion increasing treatment, and can be used. The anodization treatment and the immersing or coating treatment described above can be used in combination. Aluminum plate (so-called grained aluminum plate), which has been surface-roughened with a conventional method, can be used as a support having a hydrophilic surface.

<Hydrophilic Layer>

As one embodiment of the printing plate material used in the invention, there is a printing plate material comprising a support and provided thereon, a hydrophilic layer. The hydrophilic layer may be single or plural. The coating amount of the hydrophilic layer is preferably from 0.1 to 10 $g/m^2$, and more preferably from 0.2 to 5 $g/m^2$.

Material used in the hydrophilic layer is preferably a metal oxide. The metal oxide is preferably metal oxide particles. Examples of the metal oxide particles include colloidal silica particles, an alumina sol, a titania sol and another metal oxide sol. The metal oxide particles may have any shape such as spherical, needle-like, and feather-like shape. The average particle diameter is preferably from 3 to 100 nm, and plural kinds of metal oxide each having a different diameter may be used in combination. The surface of the particles may be subjected to surface treatment.

The metal oxide particles can be used as a binder, utilizing its layer forming ability. The metal oxide particles are suitably used in a hydrophilic layer since they minimize lowering of the hydrophilicity of the layer as compared with an organic compound binder.

Among the above-mentioned, colloidal silica is particularly preferred. The colloidal silica has a high layer forming ability under a drying condition with a relative low temperature, and can provide a good layer strength in a layer containing a substance containing no carbon in an amount of not less than 91% by weight. Preferably the colloidal silica contains necklace-shaped colloidal silica described later or colloidal silica particles with an average diameter of not more than 20 nm, and more preferably when the colloidal silica is in a dispersion, the dispersion is alkaline.

The necklace-shaped colloidal silica to be used in the invention is a generic term of an aqueous dispersion system of spherical silica having a primary particle diameter of the order of nm. The necklace-shaped colloidal silica to be used in the invention means a "pearl necklace-shaped" colloidal silica formed by connecting spherical colloidal silica particles each having a primary particle diameter of from 10 to 50 μm so as to attain a length of from 50 to 400 nm. The term of "pearl necklace-shaped" means that the image of connected colloidal silica particles is like to the shape of a pearl necklace. The bonding between the silica particles forming the necklace-shaped colloidal silica is considered to be —Si—O—Si—, which is formed by dehydration of —SiOH groups located on the surface of the silica particles. Concrete examples of the necklace-shaped colloidal silica include Snowtex-PS series produced by Nissan Kagaku Kogyo, Co., Ltd.

As the products, there are Snowtex-PS-S (the average particle diameter in the connected state is approximately 110 nm), Snowtex-PS-M (the average particle diameter in the connected state is approximately 120 nm) and Snowtex-PS-L (the average particle diameter in the connected state is approximately 170 nm). Acidic colloidal silicas corresponding to each of the above-mentioned are Snowtex-PS-S-O, Snowtex-PS-M-C and Snowtex-PS-L-C, respectively. Among them, the use of Snowtex-PS-S, Snowtex-PS-M or Snowtex-PS-L, each being alkaline colloidal silica particles, is particularly preferable since the strength of the hydrophilic layer is increased and occurrence of background contamination is inhibited even when a lot of prints are printed.

The ratio of the colloidal silica with an average diameter of not more than 20 nm to necklace-shaped colloidal silica is preferably from 95:5 to 5:95, more preferably from 70:30 to 20:8.0, and still more preferably from 60:40 to 30:70.

The hydrophilic layer of the printing plate material in the invention preferably contains porous metal oxide particles as metal oxide particles. Examples of the porous metal oxide particles include porous silica particles, porous aluminosilicate particles or zeolite particles as described later.

The porous silica particles are ordinarily produced by a wet method or a dry method. By the wet method, the porous silica particles can be obtained by drying and pulverizing a gel prepared by neutralizing an aqueous silicate solution, or pulverizing the precipitate formed by neutralization. By the dry method, the porous silica particles are prepared by combustion of silicon tetrachloride together with hydrogen and oxygen to precipitate silica. The porosity and the particle diameter of such particles can be controlled by variation of the production conditions.

The porosity of the particles is preferably not less than 1.0 ml/g, more preferably not less than 1.2 ml/g, and most preferably of from 1.8 to 2.5 ml/g, in terms of pore volume before the dispersion. The pore volume is closely related to water retention of the coated layer. As the pore volume increases, the water retention is increased, stain is difficult to occur, and water tolerance is high. Particles having a pore volume of more than 2.5 ml/g are brittle, resulting in lowering of durability of the layer containing them. Particles having a pore volume of less than 1.0 ml/g results in lowering of anti-stain property or water tolerance in printing.

The particle diameter of the particles dispersed in the hydrophilic layer (or in the dispersed state before formed as a layer) is preferably not more than 1 μm, and more preferably not more than 0.5 μm. Presence in the hydrophilic layer of particles with an extremely large diameter forms porous and sharp protrusions on the hydrophilic layer surface, and ink is likely to remain around the protrusions, which may produce stain at non-image portions of the printing plate and on the blanket of a press during printing.

Zeolite is a crystalline aluminosilicate, which is a porous material having voids of a regular three dimensional net work structure and having a pore size of 0.3 to 1 nm. Natural and synthetic zeolites are expressed by the following formula.

$$(M^1,(M^2)_{1/2})_m(Al_mSi_nO_{2(m+n)}).xH_2O$$

In the above, $M^1$ and $M^2$ are each exchangeable cations. Examples of $M^1$ include $Li^+$, $Na^+$, $K^+$, $Tl^+$, $Me_4N^+$ (TMA), $Et_4N^+$ (TEA), $Pr_4N^+$(TPA), $C_7H_{15}N^{2+}$, and $C_8H_{16}N^+$, and examples of $M^2$ include $Ca^{2+}$, $Mg^{2+}$, $Ba^{2+}$, $Sr^{2+}$ and $(C_8H_{18}N)_2{}^{2+}$. Relation of n and m is $n \geqq m$, and consequently, the ratio of m/n, or that of Al/Si is not more than 1. A higher Al/Si ratio shows a higher content of the exchangeable cation, and a higher polarity, resulting in higher hydrophilicity. The Al/Si ratio is within the range of preferably from 0.4 to 1.0, and more preferably 0.8 to 1.0. x is an integer.

The particle diameter of the porous inorganic particles dispersed in a hydrophilic layer is preferably not more than 1 μm, and more preferably not more than 0.5 μm.

The hydrophilic layer of the printing plate material in the invention can contain layer structural clay mineral particles as a metal oxide. Examples of the layer structural clay mineral particles include a clay mineral such as kaolinite, halloysite, talk, smectite such as montmorillonite, beidellite, hectorite and saponite, vermiculite, mica and chlorite; hydrotalcite; and a layer structural polysilicate such as kanemite, makatite, ilerite, magadiite and kenyte. The layer structural clay mineral particle content of the hydrophilic layer is preferably from 0.1 to 30% by weight, and more preferably from 1 to 10% by weight.

In the invention, the hydrophilic layer may contain a hydrophilic organic resin. Examples thereof include polyethylene oxide, polypropylene oxide, polyvinyl alcohol, polyethylene glycol (PEG), polyvinyl ether, a styrene-butadiene copolymer, a conjugation diene polymer latex of methyl methacrylate-butadiene copolymer, an acryl polymer latex, a vinyl polymer latex, polyacrylamide, and polyvinyl pyrrolidone.

A cationic resin may also be contained in the hydrophilic layer. Examples of the cationic resin include a polyalkylene-polyamine such as a polyethyleneamine or polypropylene-polyamine or its derivative, an acryl resin having a tertiary amino group or a quaternary ammonium group and diacrylamine. The cationic resin may be added in a form of fine particles. Examples of such particles include the cationic microgel described in Japanese Patent O.P.I. Publication No. 6-161101.

In the invention, it is preferred that the hydrophilic organic resin contained in the hydrophilic layer is a water soluble resin, and at least a part of the resin exists in the hydrophilic layer in a state capable of being dissolved in water. When the hydrophilic organic resin, which is water-soluble, is cross-linked with a cross-linking agent and water-insoluble, its hydrophilicity is lowered, resulting in deterioration of printability.

A water-soluble material contained in the hydrophilic layer in the invention is preferably a saccharide. Incorporation of the saccharide in the hydrophilic layer can increase resolution formed images and printing durability in combination with a functional layer described later having image formation capability.

As the saccharides, oligosaccharides described later can be used, but polysaccharides are preferably used. As the polysaccharides include starches, celluloses, polyuronic acid and pullulan can be used. Among them, a cellulose derivative such as a methyl cellulose salt, a carboxymethyl cellulose salt or a hydroxyethyl cellulose salt is preferable, and a sodium or ammonium salt of carboxymethyl cellulose is more preferable.

These polysaccharides can form a preferred surface shape of the hydrophilic layer.

The surface of the hydrophilic layer preferably has a convexoconcave structure having a pitch of from 0.1 to 50 μm such as the grained aluminum surface of an aluminum PS plate. The water retention ability and the image maintaining ability are raised by such a convexoconcave structure of the surface. Such a convexoconcave structure can also be formed by adding in an appropriate amount a filler having a suitable particle size to the coating liquid of the hydrophilic layer. However, the convexoconcave structure is preferably formed by coating a coating liquid for the hydrophilic layer containing the alkaline colloidal silica and the water-soluble polysaccharide so that the phase separation occurs at the time of drying the coated liquid, whereby a structure is obtained which provides a good printing performance.

The shape of the convexoconcave structure such as the pitch and the surface roughness thereof can be suitably controlled by the kinds and the adding amount of the alkaline colloidal silica particles, the kinds and the adding amount of the water-soluble polysaccharide, the kinds and the adding amount of another additive, a solid concentration of the coating liquid, a wet layer thickness or a drying condition.

The pitch in the convexoconcave structure is preferably from 0.2 to 30 μm, and more preferably from 0.5 to 20 μm. A multi-layered convexoconcave structure may be formed in which a convexoconcave structure with a smaller pitch is formed on one with a larger pitch. The hydrophilic layer has a surface roughness Ra of preferably from 100 to 1000 nm, and more preferably from 150 to 600 nm.

The thickness of the hydrophilic layer is from 0.01 to 50 μm, preferably from 0.2 to 10 μm, and more preferably from 0.5 to 3 μm.

A water-soluble surfactant may be added for improving the coating ability of the coating liquid for the hydrophilic layer in the invention. A silicon atom-containing surfactant and a fluorine atom-containing surfactant are preferably used. The silicon atom-containing surfactant is especially preferred in that it minimizes printing contamination. The content of the surfactant is preferably from 0.01 to 3% by weight, and more preferably from 0.03 to 1% by weight based on the total weight of the hydrophilic layer (or the solid content of the coating liquid).

<Image Formation Layer>

As a preferred embodiment of the printing plate material in the invention, there is a printing plate material comprising a hydrophilic support or a hydrophilic layer and provided thereon, an image formation layer capable of carrying out on-press development. The image formation layer is preferably one which forms an image by heat generated due to infrared laser light exposure.

One preferred embodiment of the image formation layer in the invention contains a hydrophobe precursor. As the hydrophobe precursor can be used a polymer whose property is capable of changing from a hydrophilic property (a water dissolving property or a water swelling property) or to a hydrophobic property by heating. Examples of the hydrophobe precursor include a polymer having an aryldiazosulfonate unit as disclosed in for example, Japanese Patent O.P.I. Publication No. 2000-56449. In the invention, the hydrophobe precursor is preferably thermoplastic hydrophobic particles or microcapsules encapsulating a hydrophobic compound. As the thermoplastic hydrophobic particles, there are heat melting particles or heat fusible particles, as described later.

The heat melting particles used in the invention are particularly particles having a low melt viscosity, which are particles formed from materials generally classified into wax. The materials preferably have a softening point of from 40° C. to 120° C. and a melting point of from 60° C. to 150° C., and more preferably a softening point of from 40° C. to 100° C. and a melting point of from 60° C. to 120° C. The melting point less than 60° C. has a problem in storage stability and the melting point exceeding 300° C. lowers ink receptive sensitivity.

Materials usable include paraffin wax, polyolefin wax, polyethylene wax, microcrystalline wax, fatty acid ester and fatty acid. The molecular weight thereof is approximately from 800 to 10,000. A polar group such as a hydroxyl group, an ester group, a carboxyl group, an aldehyde group and a peroxide group may be introduced into the wax by oxidation to increase the emulsification ability. Moreover, stearoamide, linolenamide, laurylamide, myristylamide, hardened cattle fatty acid amide, parmitylamide, oleylamide, rice bran oil fatty acid amide, palm oil fatty acid amide, a methylol compound of the above-mentioned amide compounds, methylenebissteastearoamide and ethylenebissteastearoamide may be added to the wax to lower the softening point or to raise the working efficiency. A cumarone-indene resin, a rosin-modified phenol resin, a terpene-modified phenol resin, a xylene resin, a ketone resin, an acryl resin, an ionomer and a copolymer of these resins may also be usable.

Among them, polyethylene wax, microcrystalline wax, fatty acid ester and fatty acid are preferably contained. A high sensitive image formation can be performed since these materials each have a relative low melting point and a low melt viscosity. These materials each have a lubrication ability. Accordingly, even when a shearing force is applied to the surface layer of the printing plate precursor, the layer damage is minimized, and resistance to stain which may be caused by scratch is further enhanced.

The heat melting particles are preferably dispersible in water. The average particle diameter thereof is preferably from 0.01 to 10 μm, and more preferably from 0.1 to 3 μm. When a layer containing the heat melting particles is coated on the porous hydrophilic layer, the particles having an average particle diameter less than 0.01 μm may enter the pores of the hydrophilic layer or the valleys between the neighboring two peaks on the hydrophilic layer surface, resulting in insufficient development-on-press and in stain occurrence at the background. The particles having an average particle diameter exceeding 10 μm may result in lowering of dissolving power.

The composition of the heat melting particles may be continuously varied from the interior to the surface of the particles. The particles may be covered with a different material. Known microcapsule production method or sol-gel method can be applied for covering the particles. The heat melting particle content of the layer is preferably 1 to 90% by weight, and more preferably 5 to 80% by weight based on the total layer weight. The heat fusible particles in the invention include thermoplastic hydrophobic polymer particles. Although there is no specific limitation to the upper limit of the softening point of the thermoplastic hydrophobic polymer, the softening point is preferably lower than the decomposition temperature of the polymer. The weight average molecular weight (Mw) of the thermoplastic hydrophobic polymer is preferably within the range of from 10,000 to 1,000,000.

Examples of the polymer consisting the polymer particles include a diene (co)polymer such as polypropylene, polybutadiene, polyisoprene or an ethylene-butadiene copolymer; a synthetic rubber such as a styrene-butadiene copolymer, a methyl methacrylate-butadiene copolymer or an acrylonitrile-butadiene copolymer; a (meth)acrylate (co)polymer or a (meth)acrylic acid (co)polymer such as polymethyl methacrylate, a methyl methacrylate-(2-ethylhexyl) acrylate copolymer, a methyl methacrylate-methacrylic acid copolymer, or a methyl acrylate-(N-methylolacrylamide); polyacrylonitrile; a vinyl ester (co)polymer such as a polyvinyl acetate, a vinyl acetate-vinyl propionate copolymer and a vinyl acetate-ethylene copolymer, or a vinyl acetate-2-hexylethyl acrylate copolymer; and polyvinyl chloride, polyvinylidene chloride, polystyrene and a copolymer thereof. Among them, the (meth)acrylate polymer, the (meth)acrylic acid (co)polymer, the vinyl ester (co)polymer, the polystyrene and the synthetic rubbers are preferably used.

The polymer particles may be prepared from a polymer synthesized by any known method such as an emulsion polymerization method, a suspension polymerization method, a solution polymerization method and a gas phase polymerization method. The particles of the polymer synthesized by the solution polymerization method or the gas phase polymerization method can be produced by a method in which an organic solution of the polymer is sprayed into an inactive gas and dried, and a method in which the polymer is dissolved in a water-immiscible solvent, then the resulting solution is dispersed in water or an aqueous medium and the solvent is removed by distillation. In both of the methods, a surfactant such as sodium lauryl sulfate, sodium dodecylbenzenesulfate or polyethylene glycol, or a water-soluble resin such as poly(vinyl alcohol) may be optionally used as a dispersing agent or stabilizing agent.

The heat fusible particles are preferably dispersible in water. The average particle diameter of the heat fusible particles is preferably from 0.01 to 10 μm, and more preferably from 0.1 to 3 μm. When a layer containing the heat fusible particles having an average particle diameter less than 0.01 μm is coated on the porous hydrophilic layer, the particles may enter the pores of the hydrophilic layer or the valleys between the neighboring two peaks on the hydrophilic layer surface, resulting in insufficient development-on-press and in background contamination. The heat fusible particles having an average particle diameter exceeding 10 μm result in lowering of dissolving power. (Other materials which the image formation layer may contain)

The image formation layer in the invention can further contain the following materials.

The image formation layer can also contain the light-to-heat conversion material described above. The image formation layer preferably contains a less colored material, for example, a sensitizing dye, since it is developed on a press.

The image formation layer in the invention can further contain the following water soluble resins or water dispersible resins.

Examples of the water soluble resins or water dispersible resins include oligosaccharides, polysaccharides, polyethylene oxide, polypropylene oxide, polyvinyl alcohol, polyethylene glycol (PEG), polyvinyl ether, a styrene-butadiene copolymer, a conjugation diene polymer latex of methyl methacrylate-butadiene copolymer, an acryl polymer latex, a vinyl polymer latex, polyacrylic acid, polyacrylic acid salts, polyacrylamide, and polyvinyl pyrrolidone.

Among these, oligosaccharides, polysaccharides, polyacrylic acid, polyacrylic acid salts or polyacrylamide are preferred. Examples of the oligosaccharides include raffinose, trehalose, maltose, galactose, sucrose, and lactose. Among these, trehalose is preferred.

Examples of the polysaccharides include starches, celluloses, polyuronic acid and pullulan. Among these, cellulose derivatives such as a methyl cellulose salt, a carboxymethyl cellulose salt and a hydroxyethyl cellulose salt are preferred, and a sodium or ammonium salt of carboxymethyl cellulose is more preferred. Polyacrylic acid, polyacrylic acid salt (sodium salt) or polyacryl amide has a molecular weight of preferably from 3,000 to 5,000,000, and more preferably from 5,000 to 1,000,000.

A water-soluble surfactant may be contained in the image formation layer in the invention. A silicon atom-containing surfactant and a fluorine atom-containing surfactant can be used. The silicon atom-containing surfactant is especially preferred in that it minimizes printing contamination. The content of the surfactant is preferably from 0.01 to 3.0% by weight, and more preferably from 0.03 to 1.0% by weight based on the total weight of the image formation layer (or the solid content of the coating liquid).

The image formation layer in the invention can contain an acid (phosphoric acid or acetic acid) or an alkali (sodium hydroxide, silicate, or phosphate) to adjust pH.

The coating amount of the image formation layer is from 0.01 to 10 $g/m^2$, preferably from 0.1 to 3 $g/m^2$, and more preferably from 0.2 to 2 $g/m^2$.

<Protective Layer>

A protective layer can be provided on the image formation layer. As materials used in the protective layer, the water-soluble resins or water-dispersible resins described above can be preferably used.

As the protective layer, the overcoat layer disclosed in Japanese Patent O.P.I. Publication Nos. 2002-19318 and 2002-86948 can be preferably used.

The coating amount of the protective layer is from 0.01 to 10 g/m$^2$, preferably from 0.1 to 3 g/m$^2$, and more preferably from 0.2 to 2 g/m$^2$.

<On-Press Development>

As one of the preferred embodiment of the printing plate material in the invention of the heat-melt type, the image formation layer at portions exposed by infrared laser form image portions, and the image formation layer at unexposed portions are removed to form non-image portions. Removal of the image formation layer can be carried out by washing with water, and can be also carried out by supplying dampening solution and/or printing ink to the image formation layer on a press (socalled onpress development).

Removal on a printing press of the continuous dampening water supply type of the image formation layer at unexposed portions can be carried out by bringing a dampening roller and an inking roller into contact with the image formation layer while rotating the plate cylinder, and can be also carried out according to sequence (1), (2), or (3) as described below or another appropriate sequence. The supplied amount of a dampening solution may be adjusted to be greater or smaller than the amount ordinarily supplied in printing, and the adjustment may be carried out stepwise or continuously.

(1) A dampening roller is brought into contact with the image formation layer of a printing plate material on the plate cylinder during one to several tens of rotations of the plate cylinder, and then an inking roller brought into contact with the image formation layer during the next one to tens of rotations of the plate cylinder. Thereafter, printing is carried out.

(2) An inking roller is brought into contact with the image formation layer of a printing plate material on the plate cylinder during one to several tens of rotations of the plate cylinder, and then a dampening roller brought into contact with the image formation layer during the next one to tens of rotations of the plate cylinder. Thereafter, printing is carried out.

(3) An inking roller and a dampening roller are brought into contact with the image formation layer of a printing plate material on the plate cylinder during one to several tens of rotations of the plate cylinder. Thereafter, printing is carried out.

EXAMPLES

The present invention will be explained below, employing the following examples. However, the invention is not limited thereto.

Example 1

Preparation of Support

A 0.24 mm thick aluminum plate (material 1050, refining H16) was immersed in an aqueous 1% by weight sodium hydroxide solution at 50° C. to give an aluminum dissolution amount of 2 g/m$^2$, washed with water, immersed in an aqueous 0.1% by weight hydrochloric acid solution at 25° C. for 30 seconds to neutralize, and then washed with water.

Subsequently, the aluminum plate was subjected to an electrolytic surface-roughening treatment in an electrolytic solution containing 10 g/liter of hydrochloric acid and 0.5 g/liter of aluminum at a peak current density of 50 A/dm$^2$ employing an alternating current with a sine waveform, in which the distance between the plate surface and the electrode was 10 mm. The electrolytic surface-roughening treatment was divided into 12 treatments, in which the quantity of electricity used in one treatment (at a positive polarity) was 40 C/dm$^2$, and the total quantity of electricity used (at a positive polarity) was 480 C/dm$^2$. Standby time of 5 seconds, during which no surface-roughening treatment was carried out, was provided after each of the separate electrolytic surface-roughening treatments.

Subsequently, the resulting aluminum plate was immersed in an aqueous 1% by weight sodium hydroxide solution at 50° C. and etched to give an aluminum etching amount (including smut produced on the surface) of 1.2 g/m$^2$, washed with water, neutralized in an aqueous 10% by weight sulfuric acid solution at 25° C. for 10 seconds, and washed with water. Subsequently, the aluminum plate was subjected to anodizing treatment in an aqueous 20% by weight sulfuric acid solution at a constant voltage of 20 V, in which a quantity of electricity of 150 C/dm$^2$ was supplied, and washed with water.

The washed surface of the plate was squeegeed, and the plate was immersed in an aqueous 0.1% by weight Ammonium acetate solution at 85° C. for 30 seconds, washed with water, and dried at 80° C. for 5 minutes. Thereafter, the resulting plate was immersed in an aqueous 0.1% by weight carboxymethylcellulose sodium salt solution at 90° C. for 30 seconds, washed with water, and dried at 80° C. for 5 minutes. Thus, the support 1 was obtained.

Preparation of Printing Plate Material Sample

<Printing Plate Material Sample 1 (Inventive)>

Materials described below were sufficiently mixed while stirring, and filtered to obtain image formation layer (a) coating solution with a solid content of 10% by weight. The image formation layer (a) coating solution was coated on the support 1 with a wire bar to obtain an image formation layer 1 with a dry thickness of 0.9 g/m$^2$, dried at 55° C. for 3 minutes, and then subjected to seasoning treatment at 40° C. for 24 hours. Thus, printing plate material sample 1 was prepared.

Image Formation Layer (a) Coating Solution

| | |
|---|---|
| Carnauba wax emulsion A118 (the wax having an average particle diameter of 0.3 μm, a softening point of 65° C., a melting point of 80° C., a melt viscosity at 140° C. of 8 cps, and having a solid content of 40% by weight, produced by Gifu Shellac Co., Ltd.) | 175 parts by weight |
| Trehalose (disaccharide) solution (Treha mp. 97° C., produced by Hayashihara Shoji Co., Ltd., having a solid content of 20% by weight) | 85 parts by weight |
| Aqueous solution of sodium polyacrylate: AQUALIC DL522 (solid content 30%, produced by Nippon Shokubai Co., Ltd.) | 70 parts by weight |
| Aqueous 1% by weight solution of light-to-heat conversion dye ADS830WS (produced by American Dye Source Co., Ltd.) | 300 parts by weight |
| 1% by weight water-methanol (=4:1) solution of *Bromothymol Blue (produced by Kanto Kagaku Co., Ltd.) | 300 parts by weight |
| Pure water | 70 parts by weight |

*Bromothymol Blue has a melting point (decomposition) of 200–202° C., and has a solubility in water (20° C.) of 1 g/liter and a solubility in alcohol (20° C.) of 20 g/liter.

The components above were mixed and the resulting solution was adjusted to a pH of 10.5 at 25° C. employing a 10% sodium phosphate solution to obtain an image formation layer coating solution.

The resulting image formation layer coating solution exhibited a deep blue color. The coated image formation layer exhibited a light blue to green color.

<Printing Plate Material Sample 2 (Comparative)>

Printing plate material sample 2 was prepared in the same manner as in printing plate material sample 1, except that the image formation layer coating solution was adjusted to a pH of 5.9 employing a 10% sodium dihydrogenphosphate solution. Herein, the resulting image formation layer coating solution exhibited a deep milky white green color. The coated image formation layer (dry layer) exhibited a light green color.

<Printing Plate Material Sample 3 (Comparative)>

Printing plate material sample 3 was prepared in the same manner as in printing plate material sample 1, except that Bromothymol Blue was not added to the image formation layer coating. Herein, the resulting image formation layer coating solution exhibited a deep milky white green color. The coated image formation layer (dry layer) exhibited a light green color.

<Printing Plate Material Sample 4 (Comparative)>

Printing plate material sample 4 was prepared in the same manner as in printing plate material sample 1, except that the Bromothymol Blue solution was changed to an aqueous 10% carbon black dispersion.

<Printing Plate Material Sample 5 (Inventive)>

Printing plate material sample 5 was prepared in the same manner as in printing plate material sample 1, except that the Bromothymol Blue solution was changed to an aqueous 10% phenolphthalein (mp: 258–263° C.) ethanol solution.

<Printing Plate Material Sample 6 (Inventive)>

Printing plate material sample 6 was prepared in the same manner as in printing plate material sample 1, except that the Bromothymol Blue solution was changed to an aqueous 10% Thymolphthalein (mp: 251–253° C.) ethanol solution.

<Image Formation Employing Infrared Laser>

Each of the resulting printing plate samples was wound around an exposure drum and imagewise exposed. Exposure was carried out at an exposure energy of 200, 225, 250, 275, 300, 325, 350, 375 and 400 mJ/cm$^2$, employing an infrared laser (having a wavelength of 830 nm and a beam spot diameter of 18 μm) at a resolution of 2400 dpi and at a screen line number of 175 to form a solid image, a dot image with a dot area of 1 to 99%. The term, "dpi" shows the number of dots per 2.54

<Printing Method>

Printing was carried out employing a printing press, DAIYA 1F-1 produced by Mitsubishi Jukogyo Co., Ltd., and employing a coated paper, a dampening solution, a 2% by weight solution of Astromark 3 (produced by Nikken Kagaku Kenkyusyo Co., Ltd.), and printing ink (TK Hyunity M Magenta, produced by Toyo Ink Manufacturing Co.).

Each of the exposed printing plate material samples was mounted on a plate cylinder of the printing press, and printing was carried out in the same printing sequence as a conventional PS plate. In the above, pH of the dampening solution used was adjusted to 5.0.

<Evaluation>

(Sensitivity)

When printing was carried out employing the printing plate material samples obtained by varying the exposure energy as described above, the lowest exposure energy at which dots at 4% and 96% dot image of the printed matter observed through a loupe exhibited good shape was defined as sensitivity.

(Printing Durability)

The number of printed matter whose dots of the dot image maintain good shape was defined as printing durability.

(Exposure Visualization)

An image formed on a printing plate material after infrared laser exposure was visually observed, and evaluated according to the following criteria:

A: Color difference between the non-image portions and image portions in a printing plate material after exposed at an exposure amount of not more than 250 mJ/cm$^2$ is large, and a visible image is easily observed.

B: Color difference between the non-image portions and image portions in a printing plate material after exposed at an exposure amount of not less than 250 mJ/cm$^2$ is large, and a visible image is easily observed.

C: Visible images are partially observed in a printing plate material after exposed at an exposure amount of 400 mJ/cm$^2$.

D: Visible images are slightly observed in a printing plate material after exposed at an exposure amount of 400 mJ/cm$^2$.

E: No color difference between the non-image portions and image portions in a printing plate material after exposed is observed in a printing plate material after exposed.

(Stain in Prints)

Hue difference between printing paper before printing and non-image portions of prints was visually observed and evaluated according to the following criteria:

A: No difference was observed.

B: Slight difference was observed, but no optical density difference between them was observed.

C: Apparent difference was observed and optical density of non-image portions of prints increased.

(Stain in Dampening Solution)

Thirty milliliters of each of a dampening solution in the printing press before printing and that after printing were placed in a test tube, and a difference between the solutions was observed and evaluated according to the following criteria:

A: No difference was observed.

B: Slight difference was observed, but no optical density difference between them was observed.

C: Apparent difference was observed, and optical density of the dampening solution after printing increased.

The results are shown in Table 1.

TABLE 1

| Printing plate material sample No. | Sensitivity (mJ/cm$^2$) | Exposure visualization | Printing durability (number) | Stain in prints | Stain in dampening solution | Remarks |
|---|---|---|---|---|---|---|
| 1 | 250 | A | 20,000 | A | A | Inv. |
| 2 | 275 | D | 4,000 | A | A | Comp. |
| 3 | 300 | E | 3,000 | A | A | Comp. |
| 4 | 300 | E | 4,000 | C | C | Comp. |
| 5 | 250 | B | 17,000 | A | A | Inv. |
| 6 | 250 | B | 16,000 | A | A | Inv. |

Inv.: Inventive,
Comp.: Comparative

As is apparent from Table 1 above, inventive samples 1, 5 and 6 exhibited excellent results in any of the evaluation items, but comparative samples 2, 3 and 4 exhibited poor results in at least one of the evaluation items.

The above examples were ones in which an acidic dampening solution was used. When a basic dampening solution (with a pH of not less than 8.0) was used as in newspaper printing, a printing plate material sample, comprising an image formation layer prepared from an image formation layer coating solution having a pH of less than 5.0 and containing the above visualizing material, also exhibited excellent printing durability and exposure visualization.

What is claimed is:

1. A printing process employing a printing plate material obtained by providing, on a support, a coating solution for an image formation layer capable of forming an image by heating, the process comprising the steps of:

imagewise heating the printing plate material;

choosing a dampening solution based on the acid base property of the coating solution, wherein the acid base property of the coating solution is the reverse of that of the dampening solution; and then carrying out printing supplying printing ink and a dampening solution to the heated printing plate material.

2. The printing process of claim 1, wherein the coating solution contains a visualizing material to change in color due to variation of pH of the dampening solution.

3. The printing process of claim 2, wherein the visualizing material is colored at the pH of the coating solution.

4. The printing process of claim 2, wherein the visualizing material has a melting or decomposition point of not more than 250° C.

5. The printing process of claim 3, wherein the visualizing material has a melting or decomposition point of not more than 250° C.

6. The printing process of claim 1, wherein the coating solution is basic, and the dampening solution is acidic.

7. A manufacturing process of a printing plate material comprising a support and provided thereon, an image formation layer capable of forming an image by heat, the printing plate material being imagewise heated, and then printing being carried out supplying printing ink and a dampening solution to the heated printing plate material, the process comprising the steps of:

choosing a coating solution for the image formation layer wherein the acid base property of the coating solution is reverse of that of the damping solution; and providing said coating solution for the image formation layer on a support.

8. The manufacturing process of claim 7, wherein the coating solution contains a visualizing material to change in color due to variation of pH of the dampening solution.

9. The manufacturing process of claim 8, wherein the visualizing material is colored at the pH of the coating solution.

10. The manufacturing process of claim 8, wherein the visualizing material has a melting or decomposition point of not more than 250° C.

11. The manufacturing process of claim 9, wherein the visualizing material has a melting or decomposition point of not more than 250° C.

12. The manufacturing process of claim 7, wherein the coating solution is basic, and the dampening solution is acidic.

* * * * *